US012466026B2

(12) United States Patent
Lettieri

(10) Patent No.: US 12,466,026 B2
(45) Date of Patent: Nov. 11, 2025

(54) DUSTLESS SANDING ATTACHMENT FOR POLE SANDER

(71) Applicant: Christopher Michael Lettieri, Hyde Park, NY (US)

(72) Inventor: Christopher Michael Lettieri, Hyde Park, NY (US)

( * ) Notice: Subject to any disclaimer, the term of this patent is extended or adjusted under 35 U.S.C. 154(b) by 358 days.

(21) Appl. No.: 18/320,983

(22) Filed: May 21, 2023

(65) Prior Publication Data

US 2024/0383101 A1 Nov. 21, 2024

(51) Int. Cl.
*B24B 55/10* (2006.01)

(52) U.S. Cl.
CPC ..... *B24B 55/10* (2013.01)

(58) Field of Classification Search
CPC ..... B24B 55/10; B24B 55/06; B24B 7/18; B24B 7/182; B24B 7/184; B24D 15/00; B24D 15/02; A47L 9/24; A47L 9/242; A47L 9/244; A47L 9/248
USPC ..... 451/456, 494
See application file for complete search history.

(56) References Cited

U.S. PATENT DOCUMENTS

| | | | | |
|---|---|---|---|---|
| 4,759,155 | A | 7/1988 | Shaw | |
| 4,955,748 | A | 9/1990 | Krumholz | |
| 4,964,243 | A | 10/1990 | Reiter | |
| 5,036,627 | A | 8/1991 | Walters | |
| 5,113,547 | A * | 5/1992 | Mayhew | A47L 11/4088 15/322 |
| 5,527,212 | A | 6/1996 | Bowen | |
| 5,540,616 | A | 7/1996 | Thayer | |
| 5,605,500 | A | 2/1997 | Matechuk | |
| 6,988,940 | B1 | 1/2006 | Taylor | |
| 8,226,455 | B2 * | 7/2012 | Berryhill | B24D 15/02 451/524 |
| 8,684,792 | B2 * | 4/2014 | Rocha | B24B 55/10 451/523 |
| 2004/0217591 | A1 * | 11/2004 | Wang | A47L 9/242 285/322 |
| 2023/0339063 | A1 * | 10/2023 | Caporale | B24B 23/04 |

FOREIGN PATENT DOCUMENTS

CN 205391701 U * 7/2016

OTHER PUBLICATIONS

Integrated Magnetics found at https://web.archive.org/web/20200831013923/https://www.intemag.com/neodymium-iron-boron (Year : 2020).*

* cited by examiner

*Primary Examiner* — Monica S Carter
*Assistant Examiner* — Caleb Andrew Holizna

(57) ABSTRACT

This invention relates to an attachment for a pole sander tool designed to enable dustless sanding. The attachment includes a shroud with magnetic means for quickly attaching and detaching it from the tool, forming an enclosure to capture dust particles, a port tube for connecting to the sander shaft, and a flexible bellows to provide a vacuum seal between the shroud and the port tube, allowing angular movement of the sander shaft and port tube while maintaining the seal. The port tube is connected to a vacuum source to extract dust particles.

1 Claim, 2 Drawing Sheets

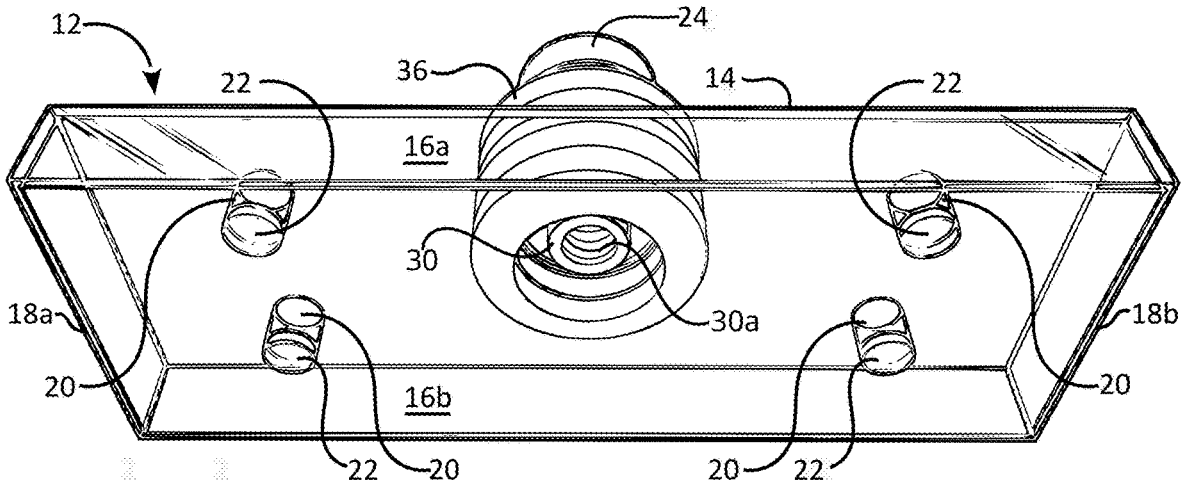
FIG. 4
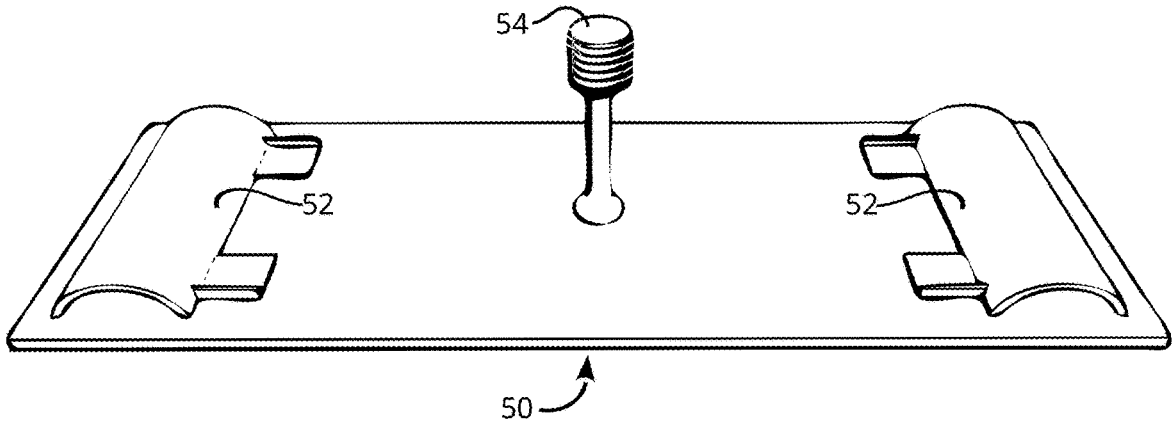

DUSTLESS SANDING ATTACHMENT FOR POLE SANDER

FIELD OF THE INVENTION

The present invention relates to dustless sanding attachments for abrasive tools, and more particularly to a dustless sanding attachment for a pole sander tool of the type for sanding drywall.

BACKGROUND OF THE INVENTION

Dustless sanding devices provide a cleaner and safer alternative to traditional sanding methods for containing the dust generated from the sanding of drywall surfaces. These manual tools typically consist of a pole and a perforated sanding block element, to which a sanding material (e.g., a sanding screen) attaches. The apertures in the sanding material allow for the extraction of drywall dust created through abrasion via a vacuum source.

In a manual dust-free sanding tool affixed with a sanding screen, the suction line or hose runs from the vacuum source, connects to the pole, and then to the sanding block member. In certain configurations, the handle features a hollowed-out architecture to accommodate the connection of a vacuum hose, with one or more vacuum tubes extending from the handle to the sanding block member.

The sanding tool is susceptible to a high coefficient of friction and the suction force exerted by the vacuum, which can impede its rasping action against the surface to be smoothed, leading to the accumulation of abraded material within the screen and the apertures of the sander block; this can diminish its ability to collect dust and reduce the overall efficacy of the dust collection process. The use of dual hose connections to the sanding block, connected in a "Y" configuration on the pole, can lead to kinking or tangling due to angular rotational movements, hindering the efficiency of the suction airflow, and thus lowering the dust collection capability.

Therefore, there is a need for an improved dustless sanding attachment.

SUMMARY OF THE INVENTION

The present invention relates to an attachment for a pole sander tool to capture and remove the dust generated by the abrasion of drywall surfaces, thereby reducing the risk of airborne particulates created through the sanding process. The dustless sanding attachment includes a dust shroud with integrated standoff posts affixed with magnets for simple and convenient connection and detachment of the shroud to the pole sander tool. The dust shroud has a planar top wall with an opening to allow the sander tool shaft to protrude and rotate at various angles and four downward extending peripheral planar side walls, forming a low-profile, rectangular box-like configuration.

The dust shroud creates an enclosed space, providing an air intake extending along the perimeter of the pole sander tool, and slightly elevated relative to the sanding surface, which allows for the capture and collection of sanding dust abraded during the sanding process and its removal via a port tube.

The port tube for connecting a vacuum source to the sander tool includes a first end integrally fitted with a coupling nut having internal threads for attachment to the shaft of the pole sander tool and a second end for connecting to a vacuum conduit.

The port tube further features channels at one end equipped with four segmented, circumferential circular arcs, augmenting the efficacy of air and dust flow. Additionally, the arc-shaped cross-sectional apertures in the port tube enable the unimpeded passage of airborne dust particles from the sander and its shroud into the vacuum conduit, providing efficient removal of the dust by the vacuum source.

A flexible bellows connects to the shroud and the port tube to create a vacuum-tight seal, and the shaft of the pole sander tool is operably and securely attached to the port tube. The flexible bellows provides an axis of rotation, enabling the shaft and the port tube to rotate while simultaneously limiting their radial displacement, thus allowing for precise control of the sander tool.

BRIEF DESCRIPTION OF DRAWINGS

The structure, features, and advantages of the present invention will become apparent upon consideration of the following detailed description and accompanying drawings, wherein:

FIG. 1 also illustrates a tubular member 48, shown as a labeled rectangular box.

FIG. 4 is an isometric view of the bottom of the invention, showing ancillary element 50, associated ferromagnetic clamp assemblies 52, and thread shaft 54 in spatial relation thereto. The coupling nut 30 and its inner threads 30*a* are also shown.

DETAILED DESCRIPTION OF THE DRAWING

The following detailed description refers to the accompanying drawings, which are incorporated herein by reference, and in which are shown, by way of illustration, the exemplary embodiments that may be practiced. It is to be understood that various changes may be made to the embodiments, including logical, mechanical, and other changes, without departing from the scope of the embodiments, and that the embodiments have been described in sufficient detail to enable those skilled in the art to practice the embodiments. The following detailed description is therefore not to be taken in a limiting sense.

Figure 1:
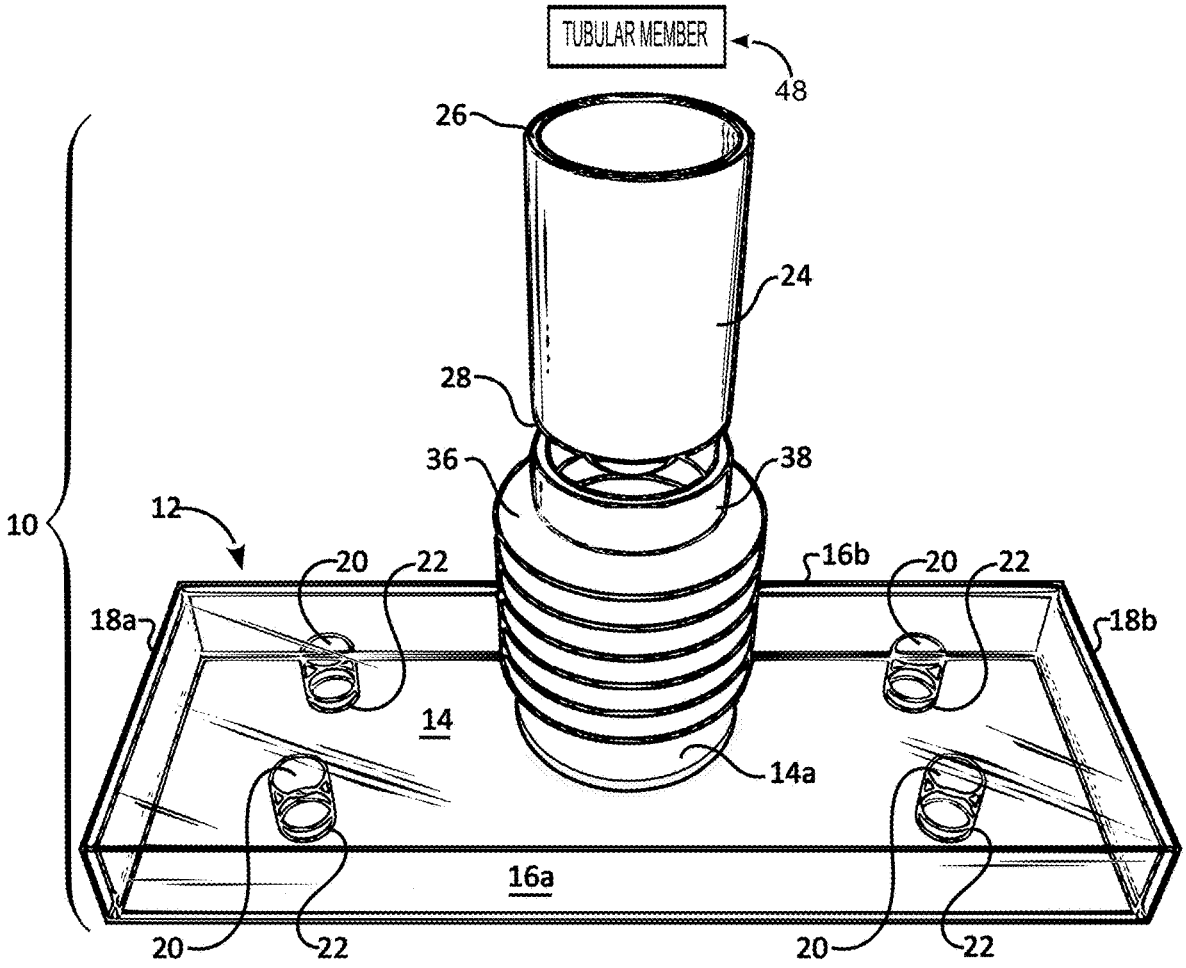
FIG. 1 is an exploded isometric view of the invention 10, with the assembly indicated by a bracket extending along the length of the exploded view.

Referring now to the drawings, FIG. 1 illustrates a preferred embodiment of the present invention, denoted 10. The present invention 10 comprises a shroud 12, a port tube 24, and a flexible bellows 36.

In FIG. 1, the shroud 12 features a circular opening 14*a* in the center of its planar top wall 14 and four planar peripheral side walls (16*a*, 16*b*, and 18*a*, and 18*b*) extending downwardly at right angles from the edges of the planar top wall 14, forming a box-shaped structure with an open bottom, as shown in FIG. 4.

The shroud 12 includes fixed-length standoff posts 20 integral to the inner surface of the planar top wall 14, configured in two parallel pairs at opposite ends of the shroud 12 and extending perpendicularly from the inner surface of the planar top wall 14, providing for alignment and positioning with respect to an ancillary sander element 50 and sanding substrate, creating a space that facilitates free air flow.

The two parallel pairs of standoff posts 20 are equipped with neodymium-iron-boron NdFeB disc magnets 22 embedded within each post, providing a secure magnetic attachment of the shroud 12 to ferromagnetic clamp assemblies 52 of the ancillary sander element 50.

The preferred material for the shroud 12 is transparent polycarbonate (PC) for impact resistance, optical clarity, and durability to enable direct visual inspection of dust entrainment and assessment of dust accumulation inside the shroud 12.

Figure 2:
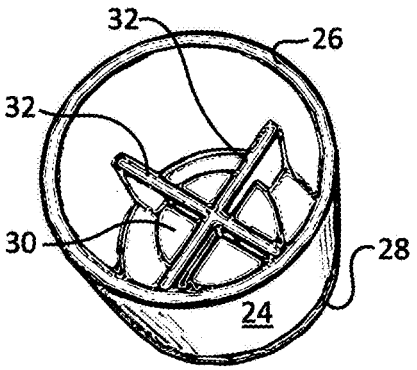
FIG. 2 is an isometric top view of the port tube 24.
Figure 3:
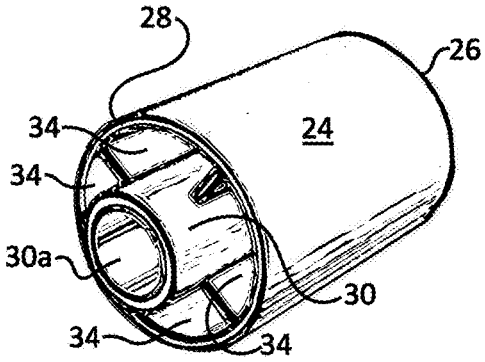
FIG. 3 is an isometric side view of the port tube 24, showing the second end 28 of the port tube 24.

As depicted in FIGS. 2 and 3, the port tube 24 is cylindrical in shape and extends along a longitudinal axis, with an open first end 26 situated at the upstream end and its open second end 28 located at the downstream end, opposite the first end 26.

The open first end 26 of the port tube 24 is designed to provide a clearance fit that allows the port tube 24 to slide along the longitudinal extents of a tubular member 48 and connect to a standard vacuum. The outer diameter of the port tube 24 is suitable for coupling a standard vacuum hose adapter.

The port tube 24 is fabricated from polypropylene (PP) due to its high flexural modulus and fatigue resistance, providing an exceptional strength-to-weight ratio, durability, and high resistance to abrasion and pressure. Additionally, port tube 24 is equipped with channels 34, which optimize the efficient flow of dust particles through the tube.

As shown in FIGS. 2 and 3, a coupling nut 30 is disposed concentrically along the central axis of the port tube 24. A first portion of the coupling nut 30 is attached to and surrounded by the inner wall of the port tube 24, and a second portion of the coupling nut 30 extends beyond a terminal surface at the second end 28 of the port tube 24, corresponding to the downstream end. The coupling nut 30 is formed integrally with the port tube 24.

The coupling nut 30 having inner threads 30*a* to provide fastening between the port tube 24 and a thread shaft 54 of an ancillary sander element 50, facilitating alignment and secure fastening of the port tube 24 to the thread shaft 54 of the ancillary sander element 50.

Radially extending from the coupling nut 30, an array of fin members 32 are positioned and bonded along their longitudinal edges to the inner wall of the port tube 24.

The fin members 32 intersect at right angles at the midpoint of the port tube 24, extend longitudinally along the inner wall of the port tube 24 and the wall of the coupling nut 30, and terminate at the second end 28 of the port tube 24, forming circular arc channels 34 between the coupling nut 30 and the inner wall of the port tube 24.

The fin members 32, arranged in a radial formation, create a circumferentially segmented pattern of channels along the inner wall of the port tube 24 and the wall of the coupling nut 30, thereby optimizing air flow through the cross-sectional area while generating a turbulent atmosphere to increase friction and the suspension of dust particles.

The high aspect ratio of arc-shaped curves within the annular space in port tube 24 enables dust particles to move through the arcuate channel surface area with minimal back pressure.

The design ensures a smooth, efficient flow of air through the circumferential circular arc channels 34, and the increased turbulence acts as a booster effect for the vacuum airflow, enabling more effective capture and suspension of particulate matter in the air.

A flexible bellows 36 creates a vacuum-tight seal between the port tube 24 and the shroud 12.

The flexible bellows 36 include a bellows having a U-shaped cross section that allows angular movement about its longitudinal axis, allowing angular rotation of the shaft and the port tube 24.

The flexible bellows 36 attaches to the opening 14*a* of the planar top wall 14 of the shroud 12, with its bottom convolution secured to the inner surface of the shroud 12 along the outer perimeter of the opening 14*a*, the sidewall of an adjacent convolution attaches to the outer surface of the planar top wall 14 along the outer perimeter of the opening 14*a*, and the bellows collar 38 attaches to the outer diameter of the port tube 24.

The flexible bellows 36, constructed from a resilient and flexible material such as rubber, provides a reliable and robust connection which enables efficient operation during significant angular motion.

The present invention 10 is suitable for dust-capture applications, providing an efficient and effective means of transferring airborne dust.

It will be apparent to one with skill in the art that the dust collection system of the invention may be provided using some or all of the mentioned features and components without departing from the spirit and scope of the present invention. It will also be apparent to the skilled artisan that the embodiments described above are specific examples of a single, broader invention, which may have a greater scope than any of the singular descriptions taught. There may be alterations made to the descriptions without departing from the spirit and scope of the present invention.

The invention claimed is:

1. A dustless sanding attachment comprising:

a shroud having a planar top wall with an aperture and four peripheral planar side walls extending downward from the planar top wall at right angles to form a box-shaped structure with an open bottom;

a parallel pair of opposing standoff posts integral to the inner surface of the top wall of said shroud, each comprising a neodymium-iron-boron NdFeB disc magnet embedded therein;

a port tube with an open first end and an open second end, the open first end designed to provide a clearance fit that allows it to slide along the longitudinal extents of a tubular member, said port tube having an array of fin members bonded along their longitudinal edges to an inner wall of said port tube;

a coupling nut having inner threads to provide fastening between said port tube and a thread shaft of an ancillary sander element, where a first portion of said coupling nut is attached to and surrounded by said inner wall of said port tube and a second portion of said coupling nut extends beyond a terminal surface of said second end of said port tube; and a flexible bellows for connecting to said shroud and said port tube, thus providing a vacuum seal therewith.

* * * * *